United States Patent [19]

Briens et al.

[11] Patent Number: 4,461,698

[45] Date of Patent: Jul. 24, 1984

[54] SOLVENT DEWAXING WAXY HYDROCARBON DISTILLATE OILS USING A COMBINATION WAX-NAPHTHALENE CONDENSATE AND POLY-DIALKYLFUMARATE/VINYL ACETATE COPOLYMER DEWAXING AID

[75] Inventors: Cedric L. Briens, Richmond; Bruce M. Sankey, Sarnia, both of Canada

[73] Assignee: Exxon Research and Engineering Co., Florham Park, N.J.

[21] Appl. No.: 426,713

[22] Filed: Sep. 29, 1982

[51] Int. Cl.[3] ..... L10G 73/04

[52] U.S. Cl. ..... 208/33

[58] Field of Search ..... 208/33

[56] References Cited

U.S. PATENT DOCUMENTS

| | | | |
|---|---|---|---|
| 2,798,027 | 7/1957 | Cohen | 196/19 |
| 3,239,445 | 3/1966 | Leonard et al. | 208/33 |
| 3,262,873 | 7/1966 | Tiedje et al. | 208/33 |
| 3,458,430 | 7/1969 | Henselman et al. | 208/33 |
| 3,475,321 | 10/1969 | Henselman | 208/33 |
| 3,729,296 | 4/1972 | Miller | 44/62 |
| 3,806,442 | 4/1974 | Reid et al. | 208/33 |
| 3,854,893 | 12/1974 | Rossi | 44/62 |
| 4,088,589 | 5/1978 | Rossi et al. | 252/56 |
| 4,153,423 | 5/1979 | Wisotsky | 44/62 |

FOREIGN PATENT DOCUMENTS

| | | |
|---|---|---|
| 1248203 | 8/1967 | Fed. Rep. of Germany . |
| 1248201 | 8/1967 | Fed. Rep. of Germany . |
| 2113780 | 6/1972 | France . |
| 44516 | 5/1970 | Japan . |
| 122277 | 12/1970 | Japan . |
| 122276 | 12/1970 | Japan . |
| 44261 | 4/1977 | Japan . |
| 77382 | 6/1977 | Japan . |
| 930968 | 7/1963 | United Kingdom . |
| 1151385 | 5/1969 | United Kingdom . |

*Primary Examiner*—Delbert E. Gantz
*Assistant Examiner*—Glenn A. Caldarola
*Attorney, Agent, or Firm*—Joseph J. Allocca

[57] ABSTRACT

This invention relates to solvent dewaxing processes for dewaxing waxy hydrocarbon oil distillates employing a dewaxing aid which dewaxing aid is a mixture of (a) a poly-dialkylfumarate/vinyl acetate copolymer and (b) a wax-naphthalene condensation product. Component (a) has pendent alkyl side chain groups of from 16 to 30 carbon atoms in length (excluding branching) with an average pendent side chain carbon length of predominantly (>50%) $C_{22}$. Component (a) has a number average molecular weight of from about 1,000 to 100,000 preferably greater than about 5,000. Component (b) has a number average molecular weight of at least about 1,000. The combination (a) and (b) may be employed in a weight ratio (A)/(B) within the range from about 1/10 to 20/1 preferably about ⅓ to 6/1 most preferably about 3/1 and at an aid dose level ranging from about 0.005 to 2.0 wt. % preferably 0.01 to 0.2 wt. % active ingredient.

7 Claims, 1 Drawing Figure

INFLUENCE OF POLYDIALKYLFUMARATE VINYLACETATE/ WAX NAPHTHALENE CONDENSATE CONCENTRATION RATIO ON THE FEED FILTER RATE AND THE DEWAXED OIL YIELD

Incremental Dilution —— 600 N (Total Dewaxing Aid Concentration: 0.1 Wt% as received on Feed)

INFLUENCE OF POLYDIALKYLFUMARATE VINYLACETATE/ WAX NAPHTHALENE CONDENSATE CONCENTRATION RATIO ON THE FEED FILTER RATE AND THE DEWAXED OIL YIELD

Incremental Dilution —— 600 N (Total Dewaxing Aid Concentration: 0.1 Wt% as received on Feed)

SOLVENT DEWAXING WAXY HYDROCARBON DISTILLATE OILS USING A COMBINATION WAX-NAPHTHALENE CONDENSATE AND POLY-DIALKYLFUMARATE/VINYL ACETATE COPOLYMER DEWAXING AID

DESCRIPTION OF THE INVENTION

This invention relates to solvent dewaxing processes for dewaxing waxy hydrocarbon oil distillates employing a dewaxing aid which dewaxing aid is a mixture of (a) a poly-dialkylfumarate/vinyl acetate copolymer and (b) a wax-naphthalene condensation product. Component (a) has pendent alkyl side chain groups of from 16 to 30 carbon atoms in length (excluding branching) with an average pendent side chain carbon length of predominantly (>50%) $C_{22}$. Component (a) has a number average molecular weight of from about 1,000 to 100,000 preferably greater than about 5,000. Component (b) has a number average molecular weight of at least about 1,000. The combination (a) and (b) may be employed in a weight ratio (A)/(B) within the range from about 1/10 to 20/1 preferably about ⅓ to 6/1 most preferably about 3/1 and at an aid dose level ranging from about 0.005 to 2.0 wt.%, preferably about 0.01 to 0.2 wt.% active ingredient. Typical of wax-naphthalene condensation products is material prepared from 125°–127° F. melting point wax while typical of polydialkylfumarate/vinyl acetate copolymers which function in the present invention is behenyl fumarate/vinyl acetate copolymer.

This dewaxing aid combination aids in solvent dewaxing processes wherein a waxy hydrocarbon oil distillate is mixed with a normally liquid dewaxing solvent and a quantity of the recited dewaxing aid combination to form a mixture which is chilled either directly using cold dewaxing solvent or indirectly in heat exchange apparatus to form a slurry comprising wax particles and a solution of dewaxed oil and dewaxing solvent. The dewaxing aid components (a) and (b) may be precombined one with the other for addition to the waxy oil distillate to be dewaxed, either as such or diluted in a suitable wax-free oil to improve flow properties. Alternatively, the components may be added separately and simultaneously or separately and sequentially at the same or separate points within the process. Even in this embodiment the individual components (a) and (b) may be employed as such or diluted in a suitable wax-free oil to improve flow properties. The wax particles which are precipitated are subsequently separated from the dewaxed oil by any of a number of typical liquid/solid separation processes exemplified by, but not limited to, filtration, settling, centrifugation, etc.

The use of the combination (a) plus (b) results in increased separation rates as compared to using no aid at all or using either component individually.

BACKGROUND OF THE INVENTION

Waxes in wax-containing hydrocarbon oils are removed therefrom by chilling the oil to precipitate out the wax and then separating the solid wax particles from the dewaxed oil by solid/liquid separation procedures such as filtration, centrifugation, settling, etc. Industrial dewaxing process include press dewaxing processes wherein the wax-containing oil, in the absence of solvent, is chilled to crystallize out the wax particles, which are then pressed out by a filter. In general, only light hydrocarbon oil fractions are treated by press dewaxing processes due to viscosity limitations. More widely used are solvent dewaxing processes wherein a waxy oil is mixed with a solvent and then chilled to precipitate the wax as tiny particles or crystals thereby forming a slurry comprising solid wax particles and a solution of dewaxed oil containing dewaxing solvent. The slurry is then fed to a wax separator (e.g. filter, centrifuge, settler) wherein the wax is removed from the dewaxed oil and dewaxing solvent. Solvent dewaxing processes are used for heavier oil fractions such as lubricating oil fractions and bright stocks. Typical dewaxing solvents include low boiling point, normally gaseous autorefrigerative hydrocarbons such as propane, propylene, butane, pentane, etc., ketones such as acetone, methyl ethyl ketone (MEK), methyl isobutyl ketone (MIBK) and mixtures thereof, aromatic hydrocarbons such as benzene, toluene and xylene as well as mixtures of ketones and aromatic hydrocarbons such as MEK/toluene and acetone/benzene and mixtures of ketones with autorefrigerants such as acetone/propylene.

One of the factors tending to limit the capacity of a solvent dewaxing plant is the rate of wax filtration (and separation in general) from the dewaxed oil, which in turn is strongly influenced by the crystal structure of the precipitated wax. Although the crystal structure of the precipitated wax is influenced by various operating conditions in the dewaxing process, for any given feed it is most strongly influenced by the chilling conditions. The size and crystal structure of the precipitated wax, occlusion of oil in the wax crystal and the condition of the oil left in the crystal are extremely varied and depend on the wax composition and precipitation conditions. These conditions also affect the separation (filtration) rate of the dewaxed oil from the wax and the yield of dewaxed oil. In some cases, most notably when the waxy oil is a bright stock, the wax crystals are of an extremely fine size and not all are separated by filtration, but some leave the filter with the dewaxed oil component which creates an objectionable haze in the oil.

One way of improving the filtration rate and minimizing haze formation is to add a dewaxing aid to the wax containing oil during the dewaxing process.

PRESENT INVENTION

Figure 1:
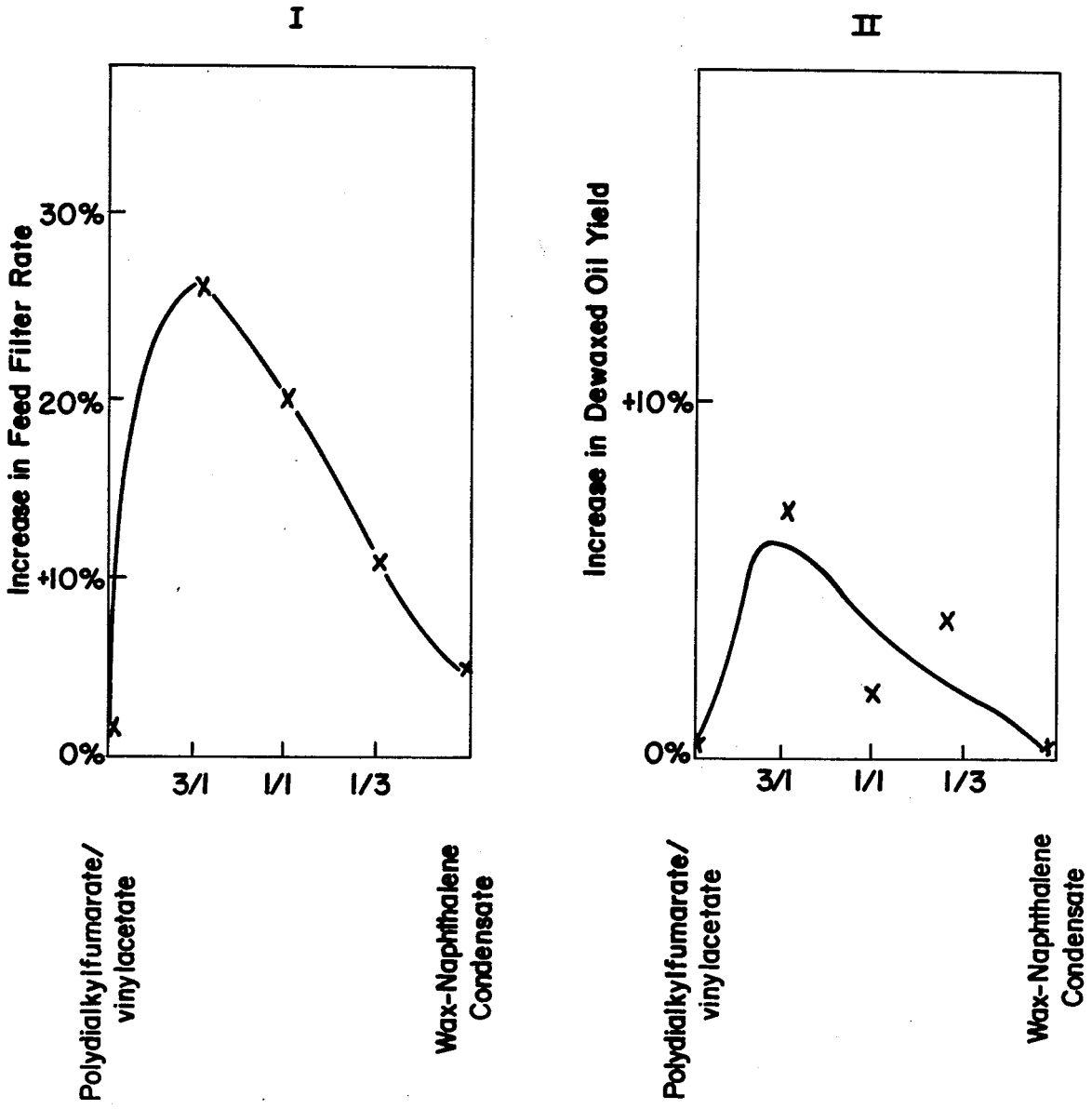
FIG. 1 (I and II) presents the influence on feed filter rate and dewaxed oil yield of the concentration ratio of the components of the combination dewaxing aid used in the present invention to dewax distillate.

This invention relates to solvent dewaxing processes for dewaxing waxy hydrocarbon oil distillates employing a dewaxing aid which dewaxing aid is a mixture of (a) a poly-dialkylfumarate/vinyl acetate copolymer and (b) a wax-naphthalene condensation product. Component (a). Component (a) has pendent alkyl side chain groups of from 16 to 30 carbon atoms in length (excluding branching) with an average pendent side chain carbon length of predominantly (>50%) $C_{22}$ (preferably the pendent alkyl side chain groups are substantially linear, i.e. little or no branching). Component (a) has a number average molecular weight of from 1,000 to 100,000 preferably about 5,000 to 50,000. Component (b) has a number average molecular weight of at least about 1,000 preferably 3,000 to 200,000, more preferably 5,000 to 10,000. The combination (a) plus (b) may be employed in a weight ratio within the range from about 1/10 to 20/1 preferably about ⅓ to 6/1 most preferably about 3/1 and at an aid dose level ranging from about 0.005 to 2.0 wt.%, preferably about 0.01 to 0.2 wt.% active ingredient.

This dewaxing aid is advantageously employed as separately prepared components (a) and (b). These components may then be mixed together in the previously recited ratios and added at the desired dose level either as such or dissolved in a suitable wax-free oil such as mineral oil or other suitable solvent such as toluene, benzene, propane, methylene chlorided and the like which imparts to the additive improved flow properties, pumpability, etc. Alternatively, the individual components (a) and (b) can be employed separately (again either as such or dissolved in a solvent as previously indicated) and introduced to the dewaxing process simultaneously or sequentially at separate points within the process. The aid, regardless of whether both components are premixed one with the other, or employed separately/simultaneously or separately/sequentially with or without dilution, may be either mixed with the waxy oil prior to chilling, or introduced during the chilling process in either indirect chilling means, such as scraped surface chillers, or alternatively, direct chilling means employing cold solvent. Preferred direct chilling means employing cold solvent injected along a number of stages therein a number of which stages are highly agitated insuring instantaneous mixing is the DILCHILL$^R$ (registered service mark of Exxon Research and Engineering Company) process as presented in U.S. Pat. No. 3,773,650, hereby incorporated by reference.

The dialkylfumarate component has pendent alkyl side chain groups of from 16 to 30 carbon atoms in length with an average pendent side chain carbon length of predominantly (>50%) $C_{22}$. Preferably the dialkylfumarate component is behenyl fumarate. The component (a) copolymer has a number average molecular weight of about 1,000 to 100,000, preferably about 5,000 to 50,000. The poly-dialkylfumarate/vinyl acetate copolymers employed as component A of the present invention are typically prepared by the procedure presented in U.S. Pat. No. 3,729,296.

Samples of materials representative of those both within the scope and outside the scope of the present invention and employed in the Examples of this specification were examined and were determined to have the following general characteristics.

A representative poly di-n-alkylfumarate/vinyl acetate copolymer having predominantly $C_{20}$ pendent alkyl side chains (63% $C_{20}$, 25% $C_{22}$, 12% Other) possessed a number average molecular weight of about 26,400 and a weight average molecular weight of about 110,000 with a 10–90 mole % number average molecular weight of about 5,000 to 70,000.

A representative poly di-n-alkylfumarate/vinyl acetate copolymer having predominantly $C_{22}$ pendent alkyl side chains (behenyl side chains) (70% $C_{22}$, 15% $C_{20}$, 15% $C_{18}$) possessed a number average molecular weight of about 8,600 and a weight average molecular weight of about 60,900 with the 10–90 mole % number average molecular weight of about 1,000 to 20,000.

Molecular weights were determined by gel permeation chromatography calibrated on polystyrene.

While the samples presented above were not the exact samples employed in the Examples of the present specification, it is believed they are fairly representative of such samples and serve to demonstrate the general characteristics of materials which satisfy the requirement of the present invention, as well as of those which do not so satisfy those requirements.

The wax-naphthalene condensation product employed as Component (b) is a typical Freidel-Crafts condensation product prepared in accordance with the procedures outlined in U.S. Pat. No. 3,458,430 or U.S. Pat. No. 3,910,776.

The normally liquid dewaxing solvent that is used in the present invention is not particularly critical; thus, any of the well-known normally liquid dewaxing solvents can be used. For example, at least one member selected from ketones having from 3 to 6 carbon atoms, such as acetone, dimethyl ketone, methyl ethyl ketone, methyl propyl ketone and methyl isobutyl ketone and mixtures thereof, aromatic hydrocarbons such as toluene, mixtures of $C_3$–$C_6$ ketones with at least one member selected from an aromatic hydrocarbon such as benzene, xylene or toluene, such mixture being, for example methyl ethyl ketone/toluene or methyl isobutyl ketone/toluene. Also useful are halogenated hydrocarbons such as methylene chloride. Further, N-alkylpyrrolidones such as N-methyl-pyrrolidone and N-ethyl-pyrrolidone may be used as components of the dewaxing solvent. Solvents which may be especially preferred for practicing the process of the present invention include the aromatic solvent such as toluene, the $C_5$–$C_6$ ketone such as MEK, MIBK and mixtures thereof, mixtures of a ketone and an aromatic hydrocarbon such as MEK/toluene, methylene chloride and mixtures of acetone and methylene chloride.

The waxy oils treated by the process of the present invention employing the above-recited dewaxing aids are waxy oils derived from distillates and are typically characterized as boiling predominantly within the range of about 300° C. to 600° C. and with viscosities from about 3–12 cSt/100° C., density of about 0.80–0.90 g/cc @ 15° C., a pour point of about 30°–50° C. and a dry wax content of about 10–25 wt/%. A typical 600N distillate was examined and found to have a boiling range of 400°–550° C., a density of 0.8745 g/cc @ 15° C., a viscosity of 10.1 cSt/100° C., a pour point of 50° C. and a dry wax content of 21 wt%.

These distillates can be obtained from any convenient source such as paraffinic crudes (Aramco, Kuwait, the Panhandle, North Louisiana, etc.) naphthenic crudes (Tia Juana, Coastal, etc.), hydrocracked products and synthetic feedstocks such as derived from tar sand oils, heavy crude oil, shale oil, coal oils, etc.

The most preferred stocks are the distillate cut fractions which include lubricating oils and specialty oil fractions boiling within the range of 300° to 600° C.

In an embodiment of the process of this invention, a solution of dewaxing aid comprising components (a) and (b) dissolved in an appropriate solvent such as a light heating oil or a light dewaxed mineral oil fraction is mixed into the wax-containing oil and the mixture heated to a temperature higher than the cloud point of the oil (typically about 50° to 120° C.). This mixture is introduced, along with the dewaxing solvent, into a chilling zone and chilled to a temperature necessary to yeild the desired pour point for the resulting dewaxed oil. The chilling produces a slurry comprising dewaxed oil and solvent along with solid patricles of wax which contain the dewaxing aid. This slurry is then sent to wax separation means, typically a wax filter to separate the dewaxed oil and solvent from the wax particles. The dewaxing temperature or temperature to which the slurry is chilled varies depending on the feed and conditions. In general, this temperature will range from about 0° to about −50° C. In the case where the dewaxing solvent comprises a mixture of a ketone and an aromatic hydrocarbon, such as methyl ethyl ketone/toluene, the dewaxing temperature will range from about −10° to about −30° C.

Preferred dewaxing solvents used in the process of this invention include aromatic hydrocarbons, such as toluene, $C_3$–$C_6$ ketones, such as MEK, MIBK and mixtures thereof, mixtures of a ketone and an aromatic hydrocarbon (such as MEK/Toluene) as well as a mixture of a ketone and methylene chloride. The ratio of solvent to waxy oil would generally range from about 0.5 to 10 and preferably from about 2 to 7, by volume. The optimum amount of dewaxing solvent employed is, of course, determined by the wax content of the oil, viscosity, pretreatment and dewaxing conditions.

EXAMPLE 1

A waxy 600N distillate with a boiling point of about 400°–550° C. and a viscosity of 10.1 cSt at 100° C. was dewaxed in a bench scale vertical screaper. The unit comprised a 13 cm ID steel cylinder which was 30 cm high. The walls were scraped by two vertical aluminum blades which were attached to a central shaft rotating at 28 rpm. Chilling of the scraper contents was accomplished by immersion in a refrigerant bath. The chilling rate of the scraper contents was about 5° C./min.

The dewaxing aid combination to be tested (which had already been mixed) was added to the waxy feed at about 70° C. to give the specified treat rate. The treated feed was then mixed with the predilution solvent and introduced into the scraper. The mixture was then chilled progressively and the solvent increments were added at appropriate temperatures. When filtration temperature (about −10° C.) was reached, the scraper were removed and the filtration performance of the wax slurry was measured with a small vacuum leaf filter at a vacuum of 12 in. Hg.

The solvent used in this example was a 45/55 mixture of Methyl-Ethyl Ketone and Methyl-Isobutyl Ketone. The dilution ratio at filtration was 2.5 volumes of ketone solvent per volume of waxy feed.

A commercial example of dewaxing aid component (a) A-1 (a behenyl fumarate/vinyl acetate copolymer) was used in combination with a commercial example of dewaxing aid component (b) B, a wax/naphthalene product prepared from 125°–127° F. melting point wax. The dewaxing aid concentrations as employed in the table are given on a "as received" basis. (The amount of Active Ingredient present in commercial materials representative of the types employed in the examples are typically as follows: materials representative of Component A-1 are about 45 wt.% active ingredient; materials representative of Component B are about 30 wt.% active ingredient.) Table 1 shows the results thus obtained with dewaxing aid concentrations of 0.1 wt.% and 0.2 wt.% (on feed).

COMPARATIVE EXAMPLE

A dewaxing aid combination of a poly-dialkylfumarate/vinyl acetate copolymers outside the scope of the present invention and the wax-naphthalene condensation product of the previous example was also tested. The waxy oil distillate, the equipment and the experimental procedure used were identical to those of the previous example. The dewaxing aid components are again used in an "as received" form. (Again, materials representative of the types employed as dewaxing aids in the example typically have active ingredient concentrations as follows: for Component $A_2$, about 37 wt.% active ingredient.)

The poly-dialkylfumarate/vinyl acetate copolymer (A-2) of this example and the poly-dialkylfumarate/vinyl acetate copolymer (A-1) of the previous example are copolymers with similar side chain lengths. They are prepared by copolymerizing 1 mole of vinyl acetate per mole of dialkylfumarate following the procedure generally described in U.S. Pat. No. 3,729,296.

A-2 has a side chain carbon number distribution of: A-2—63% $C_{20}$, 25% $C_{22}$, 12% Other (predominantly $C_{20}$) while A-1 has a side chain carbon number distribution of: A-1—15% $C_{18}$, 15% $C_{20}$, 70% $C_{22}$ (predominantly $C_{22}$). The characteristic which significantly differentiates between the two is their average pendent alkyl carbon side chain length.

At a 0.2 wt% (as received) treat level, a 75/25 mixture of B and A-2 gave no significant increase in filter rate on 600N distillate, whereas mixtures of B and A-1 with concentration ratios ranging from 75/25 to 25/75 gave filter rate increases ranging from 11% to 31% for treat levels of 0.1–2.0 wt% (as received).

EXAMPLE 2

A waxy oil identical to that the example 1 was dewaxed in a bench scale DILCHILL unit which had been shown in earlier studies to be a good simulator of the industrial dilution chilling process.

The first dewaxing aid component A-1 was added to the waxy feed at 55° C. with a treat rate of 0.025% on feed. The mixture was then chilled to 0° C. by the dilution chilling process. The second dewaxing aid component B (identical to component B of Example 1) was added to the waxy slurry at 0° C. at a treat rate of 0.075% on feed. The slurry was then chilled to filtration temperature (−10° C.) in the scraped surface chiller described in example 1. The use of the combination of dewaxing aids led to a 11% increase in filter rate and a 4% increase in dewaxed oil yield.

Example 3

Tests on Bright Stock

A Bright Stock residual waxy oil with a viscosity of 32 cSt at 100° C. was dewaxed in a bench-scale vertical scraper. The unit comprised a 13 cm ID steel cylinder which was 30 cm high. The walls were scraped by two vertical aluminum blades which were attached to a central shaft rotating at 28 rpm. The chilling rate of the scraper contents was about 1.6° C./minute.

The dewaxing aid combination to be tested (which had already been mixed) was added to the waxy feed to give the specified treat rate at about 70° C. The treated feed was then mixed with the predilution solvent and introduced into the scraper. The mixture was then chilled progressively and the solvent increments were added at appropriate temperatures. When the filtration temperature (about −23 ° C.) was reached, the scraper was removed and the filtration performance of the wax slurry was measured with a small vacuum leaf filter at a vacuum of 12 in. Hg.

The solvent used in this example was a 50/50 mixture of methyl ethyl ketone and toluene. The dilution ratio at filltration was 2.7 volumes of solvent per volume of waxy feed. A 3/1 mixture of A-1/B was tested at an aid dose level of 0.4 wt.% (as received) on feed. No increase in feed filter rate was observed.

TABLE 1

EVALUATION OF DEWAXING AID MIXTURES USING DISTILLATE (600N; 10.1 cSt AT 100° C.)

| Dewaxing Aid Mixtures | DWA Concentration (Wt. % as Received) | Improvement in Feed Filter Rate | Change in Dewaxed Oil Yield |
|---|---|---|---|
| A. Single Components | | | |
| $A_1$ | 0.1 | 1% | −2% |
| B | 0.1 | 5% | 0% |
| B. Mixtures | | | |
| $A_1$ | 0.05 | | |
| B | 0.15 | 31% | +5% |
| $A_1$ | 0.025 | | |
| B | 0.075 | 11% | +4% |
| $A_1$ | 0.05 | | |
| B | 0.05 | 20% | +2% |
| $A_1$ | 0.075 | 26% | +7% |
| B | 0.025 | | |

What is claimed is:

1. A solvent dewaxing process comprising mixing a waxy hydrocarbon oil distillate with dewaxing solvent and a dewaxing aid, wherein said dewaxing aid comprises a mixture of:

A. a poly-dialkylfumarate/vinyl acetate copolymer having pendent alkyl side chain groups containing from 16 to 30 carbons in length with an average pendent side chain length of predominantly (>50%) $C_{22}$; and B. a wax-naphthalene condensation production, wherein components (A) and (B) constituting the dewaxing aid are used in a weight ratio to each other ranging from about 1/10 to 20/1 of (A)/(B), and chilling said oil/dewaxing solvent/dewaxing aid mixture to form a slurry comprising solid particles of wax and a solution of dewaxed oil and dewaxing solvent and separating said wax from said dewaxed oil solution.

2. The process of claim 1 wherein the poly-dialkylfumarate/vinyl acetate copolymer has a number average molecular weight of from about 1,000 to 100,000 and the wax-naphthalene condensation product has a number average molecular weight of at least about 1,000.

3. The process of claim 1 or 2 wherein said dewaxing aid is employed to a dose level ranging from about 0.005 to 2 wt.% active ingredient.

4. The process of claim 3 wherein components (A) and (B) constituting the dewaxing aid are used in a weight ratio to each other ranging from about ⅓ to 6/1 of (A)/(B) and at an aid dose level of about 0.01 to 0.2 wt.% active ingredient.

5. The method of claim 3 wherein said dewaxing solvent is (1) a $C_3$–$C_6$ ketone and mixtures thereof; (2) aromatic hydrocarbons; (3) mixtures of ketones and aromatic hydrocarbons; (4) halogenated hydrocarbons; (5) N-alkyl pyrrolidone; (6) mixtures of acetone and methylene chloride.

6. The method of claim 5 wherein the waxy hydrocarbon oil distillate is a natural or synthetic lube oil fraction.

7. The method of claim 6 wherein the poly-dialkylfumarate/vinyl acetate copolymer is a behenyl fumarate/vinyl acetate copolymer.

* * * * *